US005660389A

United States Patent [19]

Freda, III

[11] Patent Number: 5,660,389

[45] Date of Patent: Aug. 26, 1997

[54] HISTORY BASED TRIVIA GAME WITH WEIGHTED SCORING SYSTEM

[75] Inventor: Donald R. Freda, III, Newtown Square, Pa.

[73] Assignee: Cygnus Ventures, Inc., Media, Pa.

[21] Appl. No.: 513,726

[22] Filed: Aug. 11, 1995

[51] Int. Cl.[6] ..... A63F 3/00

[52] U.S. Cl. ..... 273/249; 273/431

[58] Field of Search ..... 273/242, 243, 273/248, 249, 236, 429, 430, 431

[56] References Cited

U.S. PATENT DOCUMENTS

| | | | |
|---|---|---|---|
| 3,939,578 | 2/1976 | Coffey | 273/243 |
| 4,557,485 | 12/1985 | Lardon | 273/249 |
| 4,679,797 | 7/1987 | Sherin et al. | 273/251 |
| 4,787,639 | 11/1988 | Ross | 273/249 |
| 5,067,721 | 11/1991 | Hart | 273/243 |
| 5,083,794 | 1/1992 | Santagata | 273/249 |

*Primary Examiner*—William E. Stoll
*Attorney, Agent, or Firm*—Famiglio & Massinger

[57] ABSTRACT

A history-based trivia game wherein the answers to all questions are given in the form of a calendar year. Game components include a game board, throwing die, game pieces, playing cards and bonus markers. The object of the game is to be the first player to advance a game piece across a calendar year imprinted on the playing board by correctly answering questions found on the playing cards. A player may advance his or her playing piece one day of the calendar year for each point earned by correctly answering a question. Questions of greater difficulty are awarded a greater number of points. A weighted scoring system allows players to earn partial credit as calculated by the total number of points possible for a correct response minus a predesignated number of points depending on the degree of variation of the player's response from said correct answer.

2 Claims, 8 Drawing Sheets

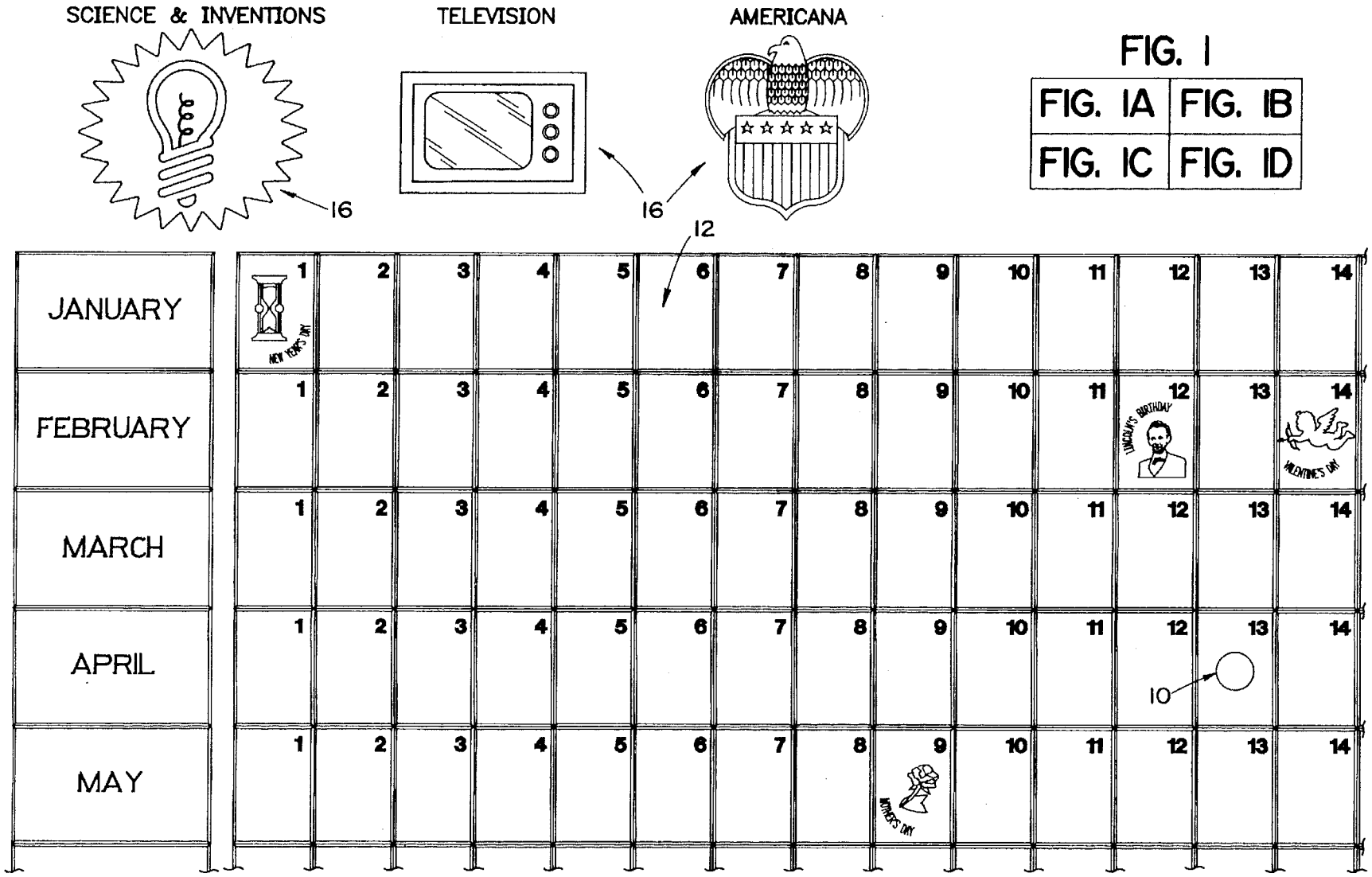
FIG. IA

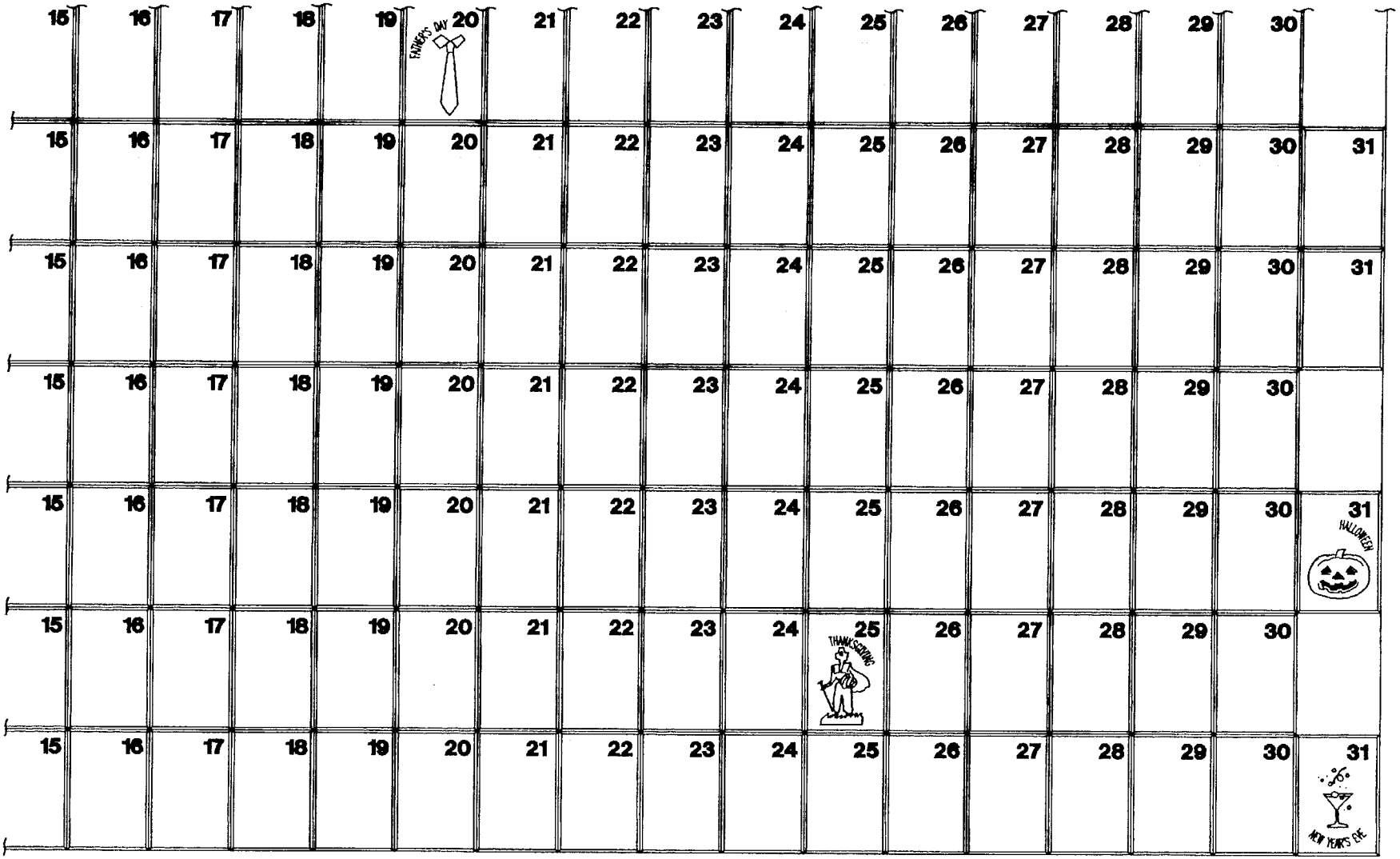
FIG. ID

SCIENCE & INVENTIONS

LEVEL: 5

What year did a 15 year old French boy, Louis Braille, invent the system of raised dots for blind people to read with ?

ANSWER

| 1724-1743 | 1744-1763 | 1764-1783 | 1784-1803 | 1804-1823 | 1824 | 1825-1844 | 1845-1864 | 1865-1884 | 1885-1904 | 1905-1924 |
|---|---|---|---|---|---|---|---|---|---|---|
| 1 | 11 | 17 | 25 | 33 | 50 | 33 | 25 | 17 | 11 | 1 |

POINTS

6

SCIENCE & INVENTIONS

LEVEL: 1

When did JVC company of Japan launch its Video Home System or VHS ?

ANSWER

| 1970 | 1971 | 1972 | 1973 | 1974 | 1975 | 1976 | 1977 | 1978 | 1979 | 1980 |
|---|---|---|---|---|---|---|---|---|---|---|
| 5 | 10 | 15 | 17 | 20 | 30 | 20 | 17 | 15 | 10 | 5 |

POINTS

6

SCIENCE & INVENTIONS

LEVEL: 5

When was the stethoscope invented ?

ANSWER

| 1716-1735 | 1736-1755 | 1756-1775 | 1776-1795 | 1796-1815 | 1816 | 1817-1836 | 1837-1856 | 1857-1876 | 1877-1896 | 1897-1916 |
|---|---|---|---|---|---|---|---|---|---|---|
| 1 | 11 | 17 | 25 | 33 | 50 | 33 | 25 | 17 | 11 | 1 |

POINTS

6

SCIENCE & INVENTIONS

LEVEL: 1

When did the Viking spacecraft land on Mars ?

ANSWER

| 1971 | 1972 | 1973 | 1974 | 1975 | 1976 | 1977 | 1978 | 1979 | 1980 | 1981 |
|---|---|---|---|---|---|---|---|---|---|---|
| 5 | 10 | 15 | 17 | 20 | 30 | 20 | 17 | 15 | 10 | 5 |

POINTS

6

SCIENCE & INVENTIONS

LEVEL: 4

When did J. B. Dunlop invent the pneumatic tire ?

ANSWER

| 1838-1847 | 1848-1857 | 1858-1867 | 1868-1877 | 1878-1887 | 1888 | 1889-1898 | 1899-1908 | 1907-1918 | 1917-1928 | 1927-1938 |
|---|---|---|---|---|---|---|---|---|---|---|
| 2 | 9 | 16 | 24 | 30 | 45 | 30 | 24 | 16 | 9 | 2 |

POINTS

6

FIG. 2B

FIG. 4

Level 1

| Answer | −5 | −4 | −3 | −2 | −1 | 0 | 1 | 2 | 3 | 4 | 5 |
|---|---|---|---|---|---|---|---|---|---|---|---|
| Points | 5 | 10 | 15 | 17 | 20 | 30 | 20 | 17 | 15 | 10 | 5 |

Level 2

| Answer | −10 | −8 | −6 | −4 | −2 | 0 | 2 | 4 | 6 | 8 | 10 |
|---|---|---|---|---|---|---|---|---|---|---|---|
| Points | 3 | 8 | 13 | 18 | 22 | 35 | 22 | 18 | 13 | 8 | 3 |

Level 3

| Answer | −20 | −16 | −12 | −8 | −4 | 0 | 4 | 8 | 12 | 16 | 20 |
|---|---|---|---|---|---|---|---|---|---|---|---|
| Points | 6 | 12 | 19 | 23 | 27 | 40 | 27 | 23 | 19 | 12 | 6 |

Level 4

| Answer | −50 | −40 | −30 | −20 | −10 | 0 | 10 | 20 | 30 | 40 | 50 |
|---|---|---|---|---|---|---|---|---|---|---|---|
| Points | 2 | 9 | 16 | 24 | 30 | 45 | 30 | 24 | 16 | 9 | 2 |

Level 5

| Answer | −100 | −80 | −60 | −40 | −20 | 0 | 20 | 40 | 60 | 80 | *100 |
|---|---|---|---|---|---|---|---|---|---|---|---|
| Points | 1 | 11 | 17 | 25 | 33 | 50 | 33 | 25 | 17 | 11 | 1 |

HISTORY BASED TRIVIA GAME WITH WEIGHTED SCORING SYSTEM

FIELD OF THE INVENTION

The subject invention is directed to trivia games generally, and to one such game involving questions relating to the year during which specific historical events occurred, in particular. As with conventional trivia games, the players are asked to answer questions pertaining to various categories and advance towards winning by answering the questions correctly. This particular game, however, is unique in at least two respects. First, all answers are given in the form of years, regardless of the category selected, and players advance their game pieces from the beginning to the end of a single calendar year depicted on a game board. Secondly, a weighted scoring system awards varying amounts of credit to the player, depending upon how close his or her answer is to the correct answer. This "partial credit" system rewards the player, on a sliding scale, for nearly correct responses and thus makes the game more enjoyable.

BACKGROUND OF THE INVENTION

Heretofore, a number of question and answer games have found favor, but none have focused specifically on identification of the dates upon which various historical events occurred in a manner similar to the subject invention, or employed a weighted scoring system awarding varying degrees of credit depending on the accuracy of the answer given.

U.S. Pat. No. 4,674,752 issued Jun. 23, 1987 to Bradford Brothers discloses a state or territory trivia game with a game board bearing a map or representation of a particular state or territory. Game question and answer cards have eight questions relating to the history, geography or other pertinent information of a particular state or territory and the answers to same are provided on the other side of the card. While such invention discloses a trivia game, it does not suggest an invention of trivia questions whose answers are purely presented in the year of history in which a specific event occurred, nor does it involve a weighted scoring system.

U.S. Pat. No. 4,807,878 issued Feb. 28, 1989 to Tripp teaches a trivia game utilizing a game board provided with four spinners. The first spinner determines which player is to answer the question; the second spinner determines the challenging player; the third spinner determines the category of the question; and the fourth spinner determines the point value and degree of difficulty of the question. This game in the prior art utilizes eight different sets of cards with each set of cards having questions and answers from certain subject categories. This games does not suggest trivia questions whose answers are the year in history in which a specific event occurred, nor does it involve a weighted scoring system.

Another U.S. Pat. No. 4,856,780 issued Aug. 15, 1989 to Begley, discloses a trivia game which tests the players knowledge of basketball trivia specifically. During the play of the game, players advance their tokens on the board according to the role of a pair of dice. Depending on the square landed upon, the player may earn certain moves which are related to the play of the game of basketball in real life. By landing on certain spaces marked, a player can commit fouls and turn overs or be sent to the bench as in actual basketball. Likewise, this game does not show or suggest trivia questions whose answers are the year in history to which a specific event occurred, nor does it involve a weighted scoring system.

U.S. Pat. No. 4,907,808 issued Mar. 13, 1990 discloses yet another board game based on trivia associated with the well known television series and movies, STAR TREK. The game provides a plurality of knock downed models representing the Enterprise, the well known star ship in the STAR TREK series. The players move their pieces in accordance with a certain roll of the dice and a player must answer trivia questions based on the adventures of STAR TREK. Here again, however, this patent does not disclose or suggest trivia questions whose answers are the year in history in which a specific event occurred, nor does it involve a weighted scoring system.

U.S. Pat. No. 5,042,816 discloses a board game based on knowledged of the Bible. Three sources of Bible questions exist depending on the game board space encountered. Success in the game is dependent upon the knowledge of the writings contained within the Bible. This patent does not disclose or suggest trivia questions whose answers are the year in history in which a specific event occurred, nor does it involve a weighted scoring system.

Another U.S. Patent issued in 1991, U.S. Pat. No. 5,048,842 issued September 17th to Proctor, discloses a trivia game based on commercial products, slogans and personalities whose character is associated with those particular products or slogans. Cards are provided in the play of the game with appropriate information and a request for a response. Again, this patent does not suggest a game played with trivia questions whose answers are the year in history in which a specific event occurred, nor does it involve a weighted scoring system.

The following year, U.S. Pat. No. 5,083,794 was issued on Jan. 28, 1992 to Santagata and discloses a board game based on trivia questions relating to a certain decade in history in which the player selects. The game board includes spaces which originate at a first date, December of the last year of the chosen decade of the game, and descend in equally spaced chronological order to a final predetermined date, January of the first year of the chosen decade. The play of the game is directed along a continuous serpentine path between adjacent columns. The movement is directed by a spinner which is color coded to match various stacks of cards of different subject matters. Each stack of said cards contains questions and answers relating to the decade of the board game. When the question is answered correctly, the card directs the player to move forward a certain number of spaces. Randomly positioned spaces also direct players who land on them to move backwards a certain number of spaces. The object of this game is to be the first player to reach the final space. While this prior art does disclose trivia questions relating to a specific decade in history, the answer to such questions are not specific years in history. This patent does not suggest the use of trivia questions whose answers are the year in history in which a specific event occurred, nor does it employ a weighted scoring system.

On Feb. 16, 1993, U.S. Pat. No. 5,186,467 was issued to Chasin and discloses a board game based on sports trivia and memorabilia. The first deck of cards is comprised of cards having a number printed on one side. The second deck of cards is comprised of cards having a team name and year printed on the first side and a list of the team players and their corresponding numbers printed on the reverse side. The object of this prior art invention is to match the number on the card drawn from the first deck with the player on the team listed on the card from the second deck. This prior art does not disclose or suggest trivia questions whose answers are the year in history in which a specific event occurred, nor does it employ a weighted scoring system.

Canadian Patent #1,211,482 issued Sep. 16, 1986 to Thompson discloses a game board which consists, basically, of a spin wheel mounted on a stationary support base. The game is played in conjunction with question and answer cards that are coded for category and color, with the segments on the spin wheel. When the wheel is spun to determine the category, a point in value in that category for the card is selected. This patent does not disclose or suggest trivia questions whose answers are the year in history in which a specific event occurred.

Also in the prior art is a game, manufactured by the game company Milton Bradley, known as TIMES TO REMEMBER. This game, is based on trivia questions whose answers relate to the year in history in which a certain event occurred. However, in this game, there is no game board and there is a use of a wheel containing the dates 1950 to 1990, as well as seven game pieces which span a period of one to seven years. Although this game relates to time trivia, the method of play of the game differs substantially from that disclosed in the present invention. TIME TO REMEMBER has no game board upon which the players progress. Further, the accuracy of a players response does not direct the players forward movement on the game board of a game piece towards victory. TIME TO REMEMBER does not disclose a game played on a game board based on trivia questions whose answers are the year in history in which specific events occurred, nor does it involve a weighted scoring system.

SUMMARY OF THE INVENTION

The subject invention more specifically is comprised of a generally rectangular game board upon which the image of an annual calendar is depicted. The object of the game is to be the first player to advance a game piece from January 1st to December 31st, or beyond, by correctly answering questions found on playing cards. A player may advance his or her playing piece one day of the calendar year for each point earned by correctly answering a question. Questions of greater difficulty earn a greater number of points, hence, answering more difficult questions permits the player to advance his or her game piece more rapidly towards the "finish line". A weighted scoring system, described in detail below, allows players to earn partial credit as calculated by the total number of points possible for a correct response minus a predesignated number of points depending on the degree of variation of the player's response from said correct answer. In the preferred embodiment, there are six different categories of questions, each category having its representative icon. A conventional six-sided die is included; each side of the die having a different icon imprinted thereon. Players roll the die to determine from what category their question will be selected. Each category has five (5) levels of increasing difficulty. The difficulty level is randomly determined by the location of the question in each deck of cards for that particular category. A more detailed method of play and additional game components are discussed in greater detail below. The game can be played by as few as 2–6 individual players to a maximum of six teams comprised of 1–6 players per team.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Accordingly, it is a primary object of present invention to provide a history based trivia game involving questions relating to the year in which specific events in history occurred in various categories.

It is also a primary object of the present invention to provide a history based trivia game wherein the answers to questions are numerically related such that a weighted scoring system may be implemented based on how close the player's response is, quantitatively speaking, to the correct answer for each question. Application of this partial credit system permits further exploitation of the well known advantages of a reward based teaching system in the educational environment.

Another object of the present invention is to provide a history based trivia game wherein, in one embodiment, a game board is employed whereby player game pieces are advanced on the board by responding to questions accurately.

It is a further object of the present invention to provide a history based trivia game including a game board upon which a calendar year is depicted such that each day of the calendar is represented by a corresponding square. Player game pieces are advanced from the square representing January 1st, the starting point, to December 31st, the finish line.

Still another object of the present invention is to provide a history based trivia game involving questions in different categories wherein the questions of each such category may be of varying difficulty level, but always answerable in the form of a specific year in which an event occurred.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a digram of FIGS. 1A, 1B, 1C, and 1D.

FIG. 1A is a depiction of the top left quadrant of the game board of the subject history based trivia game upon which a calendar and other details related to the game are illustrated.

FIG. 1D is a depiction of the bottom right quadrant of the game board.

FIG. 2B is a sampling of additional playing cards in the category of "Science & Inventions".

FIG. 4 is a chart depicting the preselected degree of tolerance for questions of varying difficulty level and the number of points assigned to answers which appear within said degree of tolerance.

DETAILED DESCRIPTION OF THE INVENTION

Figure 1B:
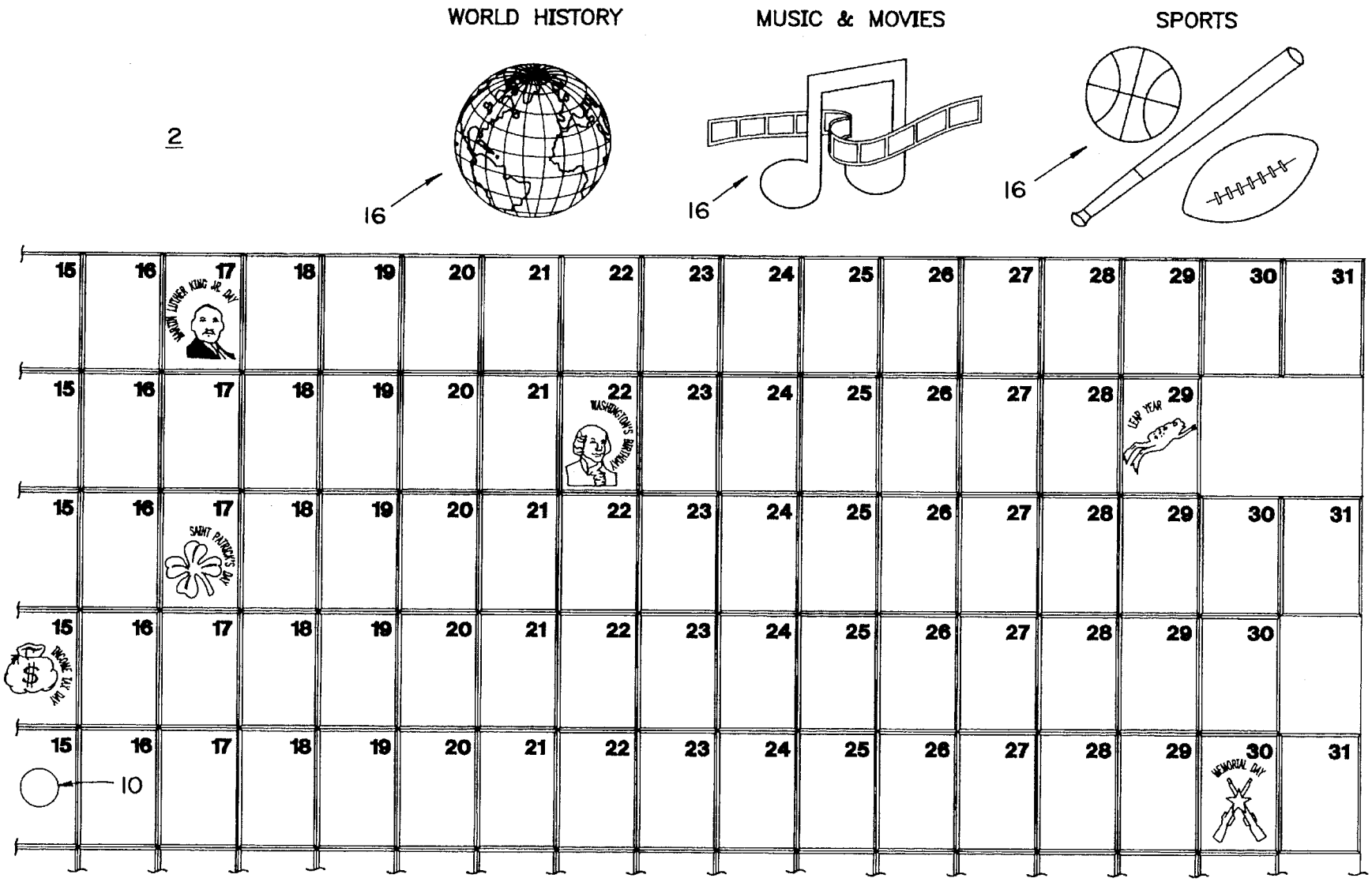
FIG. 1B is a depiction of the top right quadrant of the game board.
Figure 1C:
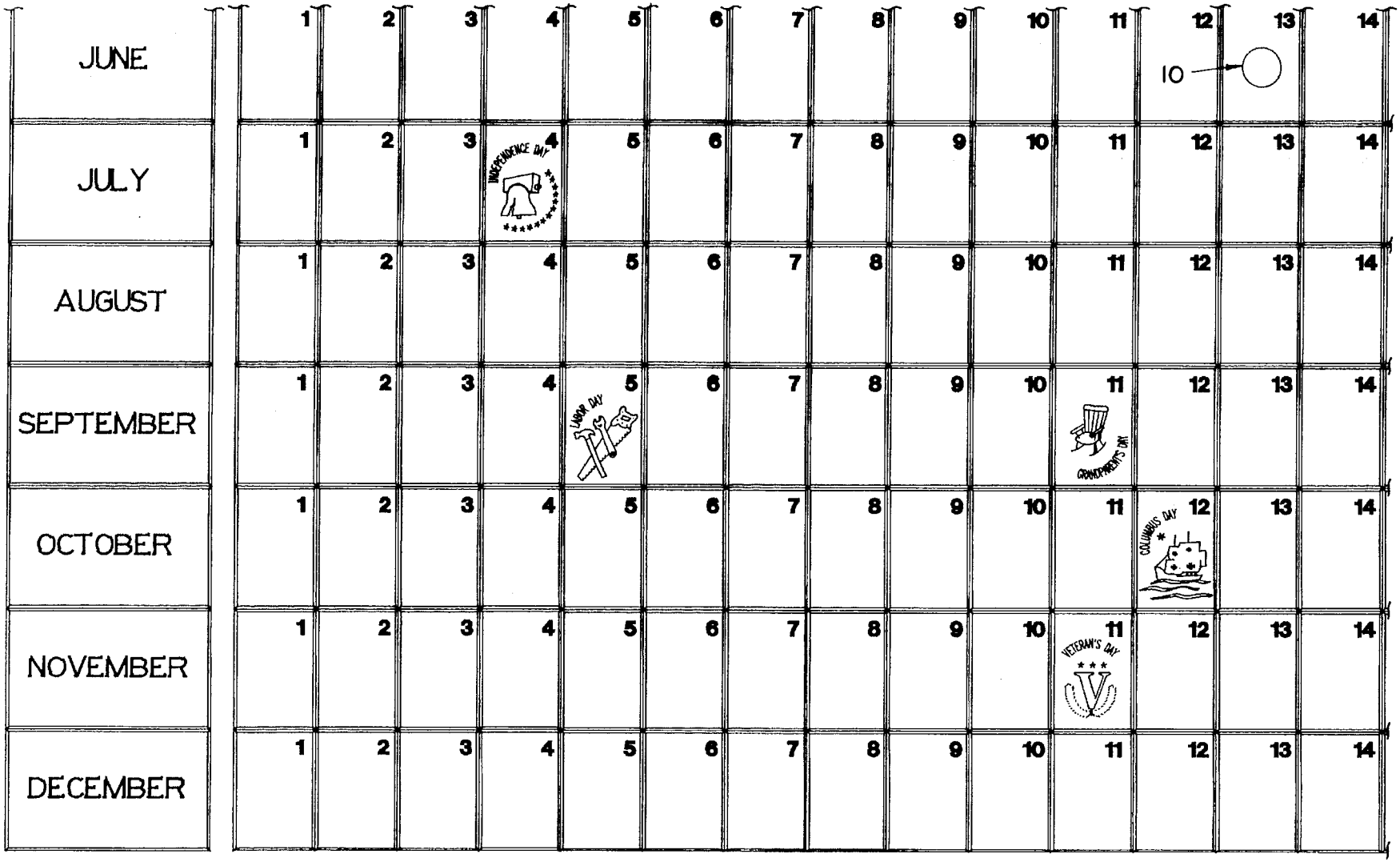
FIG. 1C is a depiction of the bottom left quadrant of the game board.

With regard to actual physical components, the subject history based trivia game is comprised of a playing board 2, a throwing die 4, and a plurality of playing cards 6, game pieces 8, and bonus markers 10. With reference now being made to FIG. 1 comprised of FIG. A, 1B, 1C and 1D, the first of these game components will be described in detail.

FIG. 1 depicts the preferred embodiment of game board 2 upon which the subject history based trivia game is played. Note that game board 2 has depicted thereon the well known Gregorian calendar having 365 days per year (366 on leap year) with each day being represented by a corresponding block 12. It may be further observed that the twelve months of the year are labeled along the left side of the board in a vertical column beginning with January at the top and ending with December at the bottom. The number of days corresponding to each month appear in a row and may be read in a conventional left to right fashion. Each block 12 has depicted therein a numeral corresponding to each day of the month. Selected holidays are also recognized and depicted in the appropriate block 12.

In the preferred embodiment, a plurality of game cards 6 are utilized. Each game card 6 has printed on one side thereof a question and its corresponding answer. Each question relates to one of six categories: SCIENCE & INVENTIONS, TELEVISION, AMERICANA, WORLD HISTORY, MOVIES & MUSIC, and SPORTS. It should be immediately apparent, however, that additional and/or alternative categories may be utilized, depending upon the interest of the players and the particular version of the game being designed.

Figure 2A:
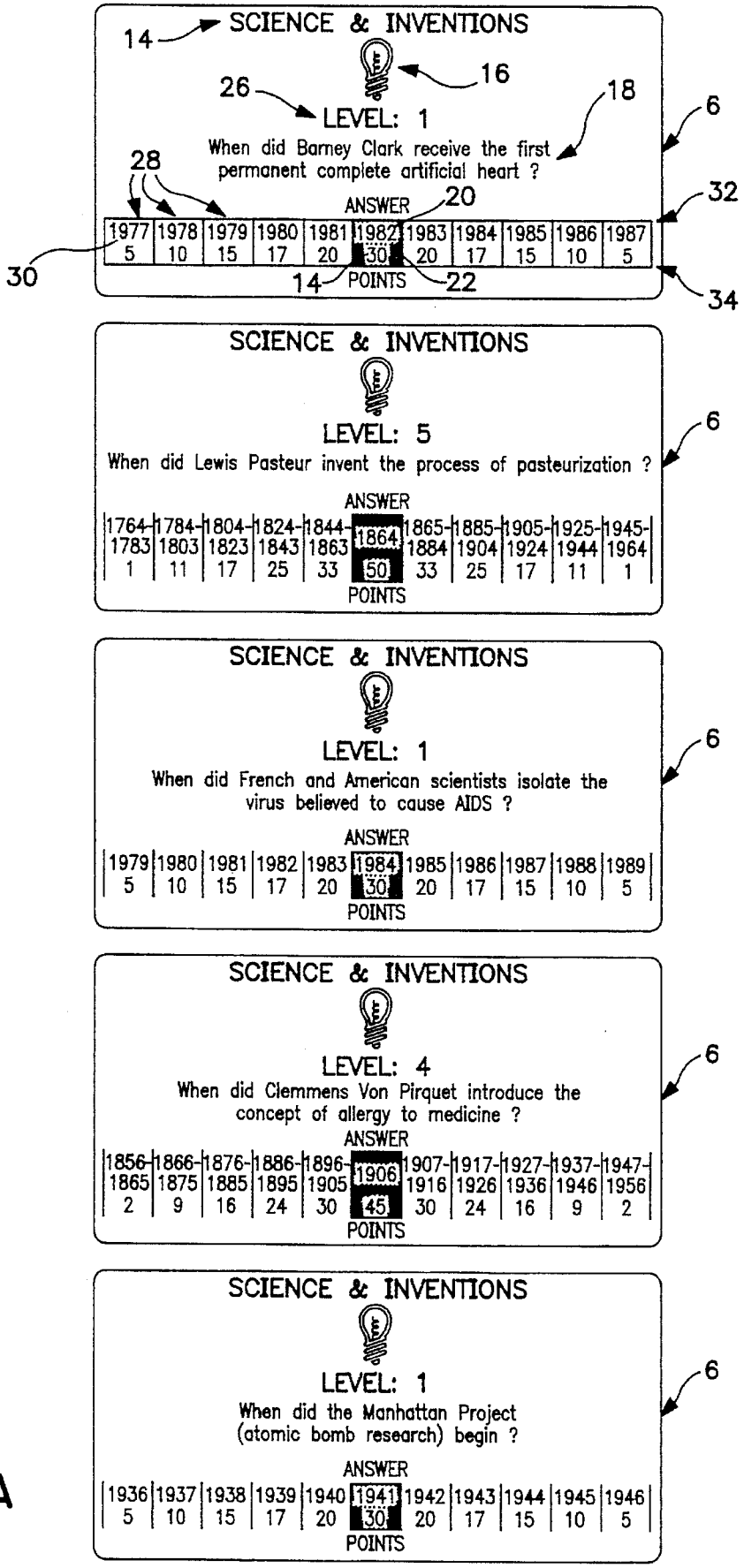
FIG. 2A is a sampling of playing cards in the category of "SCIENCE & INVENTIONS" illustrating the level of difficulty for each question and the corresponding answer.

Turning now to FIGS. 2A and 2B, the details of a sampling of playing cards 6, selected from the category "SCIENCE & INVENTION", may be observed. Referring to the first of these cards appearing at the top of FIG. 2A, the typical arrangement of features may be appreciated. The category title identifier 14 appears at the very top of each card. In the instant example, the title "SCIENCE & INVENTION" is printed, below which appears a corresponding category icon 16. Icons 16 are pictorial representations of the category which they represent. Specifically, the category TELEVISION is represented by a picture of a television set, the category SCIENCE & INVENTIONS by a lightbulb, the category AMERICANA by an American eagle and flag, the category WORLD HISTORY by a globe, the category MUSIC & MOVIES by a musical note and segment of film, and the category SPORTS by well known sporting equipment.

Figure 3:
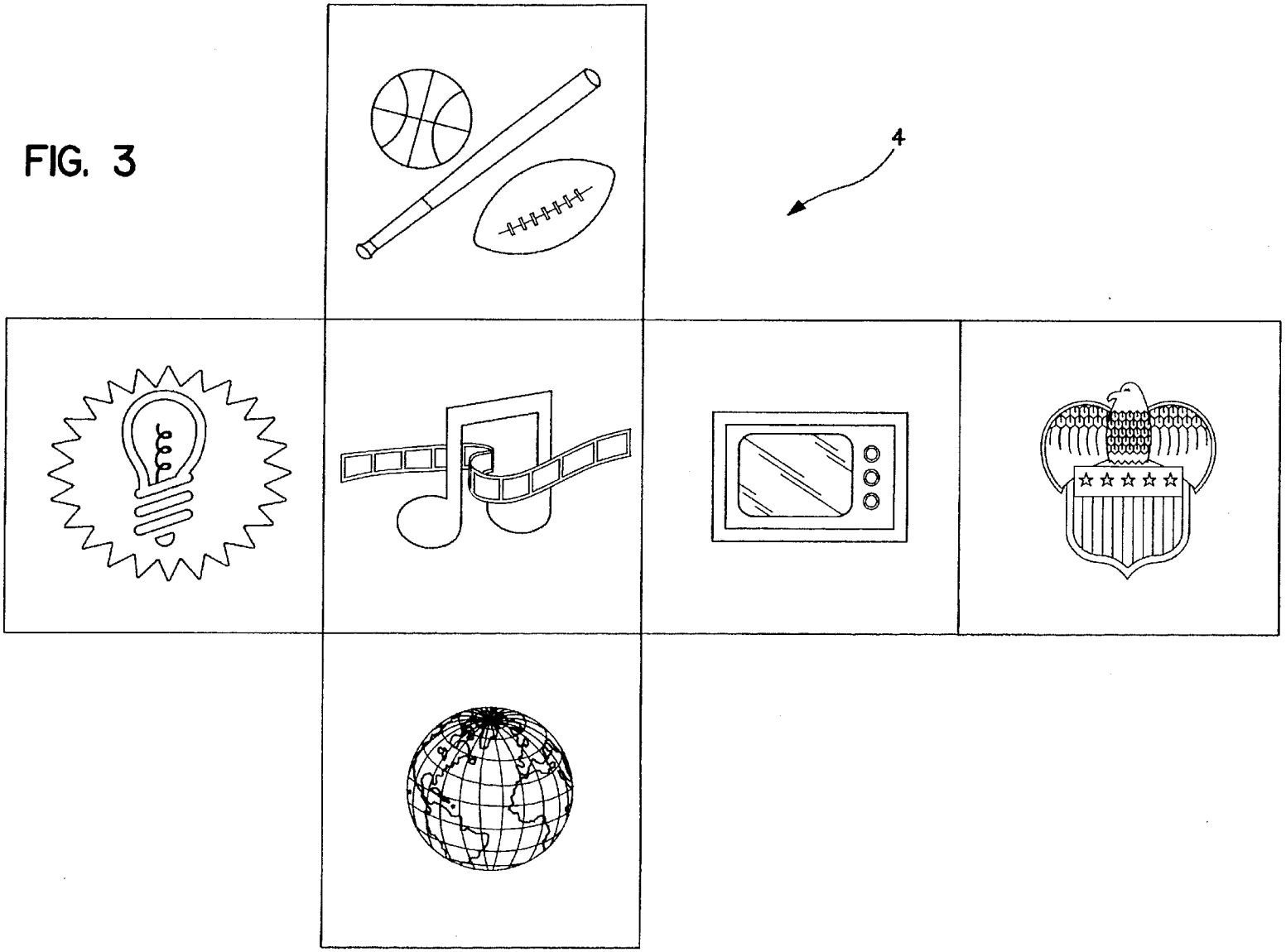
FIG. 3 depicts the six sides of the category selection throwing die of the present invention; each side containing an icon corresponding with each of the six categories used in the game.

FIG. 3 represents the category selection means used in the present invention, namely a conventional six-sided throwing die 4 upon which the above described icons 16 are imprinted. Category selection die 4 is shown in two dimensional form to better illustrate how each of its six sides has a separate icon imprinted thereon. It may be appreciated that other means of selecting the category from which a player will receive a question may be used such as a coventional spinning wheel or random printing of categories on each of the blocks 12 of game board 2 so that category selection occurs when a game piece lands on each block. In another embodiment of throwing die 4, the actual names of the categories, rather than their representative icons, are imprinted on the sides of the die.

Referring once again to FIG. 2, additional details of playing cards 6 may be explained. Directly below the category icon 16, each card 6 has imprinted thereon a question level indicator 26 followed by a single question 18. Question levels range from Level 1 thru Level 5 and reflect the difficulty of the question as measured by the obscurity of the subject matter or remoteness in time from present day. Level 1 is assigned to the simplest questions and Level 5 is assigned to the most difficult.

A cursory review of the sampling of questions appearing in FIG. 2 reveals that all questions call for an answer in the form of a year in which a particular event in history occurred. This is true, not only for the questions appearing in FIG. 2, but for all questions in the game generally. Accordingly, each question begins with a phrase such as "When did . . . ", "In what year . . . ", and so on. The correct answer 20 for each question 18 may be found in answer box 22 which has a shaded or colored background so that the year, in the form of a year, will stand out more readily. Just below the answer 20 in box 22 appears the point value 24 assigned to the correct answer 20. The number of points awarded for a correct response varies depending on the difficulty of the question. Point values are assigned as follows:

| Level | Points |
|---|---|
| 1 | 30 |
| 2 | 35 |
| 3 | 40 |
| 4 | 45 |
| 5 | 50 |

Appearing immediately to the right and left of each answer are five variance boxes 28 which contain other acceptable alternate answers 30, which deviate from the correct answer, as well as the point value assigned to the alternate answer. As will more greatly be appreciated upon reference to FIG. 4 and the corresponding text, below, this weighted scoring system is considered one of the key features of novelty of the subject invention.

Reference now being made to FIG. 4, the weighted scoring system of the subject history based trivia game will be described. Because all answers to questions are given in the form of a numeric response, it is possible to employ a scoring system which awards partial credit to responses which, although not exactly correct, are within an acceptable degree of tolerance from the correct answer 20. Generally, the point value awarded for such alternate answers 30 is calculated by the total number of points possible for a correct response minus a predesignated number of points as determined by the degree of error or variation of the player's response from said correct answer.

The predetermined degree of tolorance for each answer appears in answer tolorance columns 32. For Level 1 questions, a tolorance of plus or minus five years has been assigned in one year increments. For Level 2 questions, a tolorance of plus or minus ten years has been assigned in five two year increments. For Level 3 questions, a tolorance of plus or minus twenty years may be observed in five four year increments. For Level 4 questions, a tolorance of plus or minus fifty years has been assigned in five ten year increments and, finally, for Level 5 questions, a tolorance of plus or minus one hundred years has been assigned in five twenty year increments. The number of points assigned to each incremental unit of tolorance is printed directly below the tolorance columns 32 in award columns 34.

EXAMPLE 1

Reference once again being made to FIG. 2, and particularly to the first card depicted therein, the Level 1 question "When did Barney Clark receive the first permanent complete artificial heart?" is printed. Referring to answer box 22, the correct answer 20 is reported as "1982" with a point value 24 of 30 points. Assume, however, that the player's response was "1979", a degree of error of –3 years. Referring to FIG. 4, it can be seen that such a degree of error will result in the player being awarded 15 of the possible 30 points for this Level 1 question. Referring back to FIG. 2 again, we confirm that in variance box 28, the alternate answer 30 of "1979" receives a corresponding award of 15 points.

EXAMPLE 2

Referring now to the second card depicted in FIG. 2 situate at the upper right hand corner of said Figure, the question reads, "What year did a 15 year old French boy, Louis Braille, invent the system of raised dots for blind people to read with?". Referring to answer box 22, the correct response would be "1824". Of course, this date is rather removed in time from present day and, therefore, has been assigned a difficulty Level of 5. Referring back again to FIG. 4, we see that a correct response will be awarded 50 points. Once again, assume that the player's response is off by say 63 years; the response being "1887". A deviation ranging from 61–80 years would still be awarded 11 of the total 50 points possible. Turning back to FIG. 2, we see that the player's response of "1887" falls within the variance box 28 with dates ranging from 1885–1904 and confirm that the player will be awarded 11 points for the response.

Certainly, it would be difficult for the average player to identify the precise year in which many events took place. Ultimately, without the subject weighted scoring system, the players would likely become discouraged and lose interest altogether. This problem is frequently encountered with trivia games of the prior art which employ an "either you know it or you don't" scoring mentality. Such games of the prior art may take excessive amounts of time to play since players cannot advance along the playing board unless they provide the correct answer. By providing only questions which require a numeric response, the player is afforded the opportunity to make educated guesses which, if close, may fall within the predesignated zone of tolerance and be rewarded with at least some points. Players will quickly become familiar with the degree of tolerance for each level of question involved, thus creating an element of hope and anticipation associated with their educated guess, rather than the immediate letdown associated with an "I don't know" response. In short, close only counts in horseshoes, hand grenades and the subject time-based trivia game.

It may thus be appreciated that a primary object of the present invention is achieved by providing a trivia game wherein the answers to questions are numerically related such that a tolerance may be assigned to each correct answer, the degree of which depends on the level of difficulty of the question. Points may then be awarded on a sliding scale within said degree of tolerance with the number of points awarded being directly related to the degree of error of the player's response from the correct answer. The degree of error is, more specifically, measured as the difference in years between the actual date when an event in history occurred and that computed or guessed by the player. It may be further appreciated that the closer the response is to the correct answer 20, the more points are awarded.

Method of Play

Now that the primary physical components have been described in detail, the manner in which the game is played may be explained. It is contemplated that the game would be played by as few as 2–6 individual players to a maximum of six teams comprised of 1–6 players per team. Each team or individual first selects its game piece which is used to signify the position of the particular team on the board. All player game pieces are initially placed on the first day of the calendar year, namely January 1st. The object of the game is to be the first player to advance a game piece 8 from January 1st to the finish line of December 31st by answering the above described questions. At the beginning of the game, each team selects 6 bonus markers 10, comprised of small reusable plastic discs or dots in six colors, and places them on any six days of the calendar year. The days selected are that player's Bonus days. Bonus markers 10 are set in colors that allow easy identification and association with a particular player or team. If a playing piece 8 lands on a daily block 12 containing a bonus marker 12, that player is permitted to advance an entire month of the calendar year. Selection of bonus days is, for the most part, discretionary with only a few exceptions. While players are permitted to place markers 10 on their birthday, anniversary, or other day of the year, they are precluded from placing them in the month of December; from placing more than one of their six markers on the same day; and from placing them on any of the special holidays marked on the game board.

In the preferred embodiment, the team containing the youngest player proceeds first and thereafter, selection of players proceeds in a clockwise direction. The player rolls category selection die 4 to determine from what category his or her question will be taken. Previously described playing cards 6, which have been divided into the six categories, are placed in separate decks, face down. The corresponding category icon appears on the back of each playing card for easy identification, along with the category title. The player is then presented with the option of either taking a question from that category, or rolling die 4 again to attempt another category. If the player elects to roll the die again, he or she must select the question from that category. A card is then drawn from the top of the appropriate deck by the player behind the player who's turn it is and the question read aloud, including the level of difficulty involved. The responding player then has the option of passing the question to the next team if he or she believes it to be too difficult. Under this scenario the player to whom the question is passed receives an opportunity to earn extra points because such player will still receive their regular turn later. After the passed question is answered, the passing player still has the opportunity to answer the next question in the deck of the previously selected category. Play then resumes, and the player who just had the opportunity to earn extra points takes their normal turn.

Points are earned by either responding with the exact year during which the event in history occurred, or by responding with an answer that falls within the degree or zone of tolerance as described in detail above. The player is permitted to advance his or her game piece one daily block 12 along the calendar year for each point earned in response to the question. Playing card 6 is then returned to the bottom of the deck from which it was drawn.

If the player's game piece lands on a holiday, that player is permitted to advance the game piece an entire month. For example, if the game piece 8 lands on Valentine's day, the piece may be advanced to March 14th. Note that April 15th, tax day, has been marked on game board 2. If a player's game piece lands on this day, it must be moved back one month to March 15th. (The reason should be obvious).

Although the present invention has been described with reference to the particular embodiments herein set forth, it is understood that the present disclosure has been made only by way of example and that numerous changes in details of construction may be resorted to without departing from the spirit and scope of the invention. For instance, it is contemplated that the herein described game could also be played on a computer. In this case game board 2 would be simulated on screen as would player game pieces, etc. The manner in which the game could be reduced to a software version will be obvious to those skilled in that art. Thus, the scope of the invention should not be limited by the foregoing specifications, but rather only by the scope of the claims appended hereto.

What is claimed is:

1. A history based trivia game comprising:

(a) a game board;

(b) a plurality of game pieces;

(c) a plurality of cards with questions and corresponding answers; said answers being in the form of a specific year; and (d) a weighted scoring system for determining the number of points awarded a player's response; said number of points being a function of the degree of error of said player's response from the correct answer;

whereby each player's game piece is advanced along said game board in incremental units; the number of said units advanced being equal to the number of points earned by answering each question.

2.A history based trivia game comprising:

(a) a game board;

(b) a plurality of game pieces;

(c) a plurality of cards with questions and corresponding answers; said answers being in the form of a specific year; and (d) a weighted scoring system for determining the number of points awarded a player's response; said scoring system comprising a degree of tolerance surrounding the correct answer; said degree of tolerance being defined in terms of years; said degree of tolerance being divided into increments; and a predesignated number of points corresponding to each of said increments;

whereby each player's game piece is advanced along said game board in incremental units; the number of said units advanced being equal to the number of points earned by answering each question.

* * * * *